US006872021B1

(12) United States Patent
Wilson et al.

(10) Patent No.: US 6,872,021 B1
(45) Date of Patent: Mar. 29, 2005

(54) CLEANING ASSEMBLY

(76) Inventors: Vernell Wilson, 22125 Arbor La., Farmington Hills, MI (US) 48336; Raquelle Wilson, 22125 Arbor La., Farmington Hills, MI (US) 48336; Craig Wilson, 22125 Arbor La., Farmington Hills, MI (US) 48336

( * ) Notice: Subject to any disclaimer, the term of this patent is extended or adjusted under 35 U.S.C. 154(b) by 191 days.

(21) Appl. No.: 10/198,380

(22) Filed: Jul. 18, 2002

(51) Int. Cl.[7] ..... A47L 1/06

(52) U.S. Cl. ..... 401/268; 15/104.93; 15/228; 15/244.1; 401/137; 401/138; 401/190; 401/268; 401/272; 401/281; 285/261

(58) Field of Search ..... 285/261, 262, 285/264; 15/104.94, 227, 228, 231, 244.1–244.4; 401/138, 137, 190, 268, 270, 272, 275, 281

(56) References Cited

U.S. PATENT DOCUMENTS 4,032,239 A * 6/1977 Maupin ..... 401/203
4,822,194 A * 4/1989 Simonette ..... 401/207
5,846,011 A * 12/1998 Bernstein et al. ..... 401/205
6,101,661 A * 8/2000 Policicchio et al. ..... 15/228
6,415,470 B1 * 7/2002 Ramrattan ..... 15/144.4
6,588,045 B2 * 7/2003 Fernandez ..... 15/119.2
6,655,866 B1 * 12/2003 Morad et al. ..... 401/139

* cited by examiner

*Primary Examiner*—Robert J. Warden, Sr.
*Assistant Examiner*—S Balsis
(74) *Attorney, Agent, or Firm*—Law Offices of John Chupa and Assoc., P.C.

(57) ABSTRACT

A cleaning assembly 10 having a telescoping handle portion 12 and a sponge member 40 which is pivotally coupled to the telescoping handle portion 12. In various non-limiting embodiments, the cleaning assembly 10 may include material, such as but not limited to, material 80 which is selectively communicated to the sponge member 40, effective to aid in the cleaning of an object and/or area.

4 Claims, 4 Drawing Sheets

CLEANING ASSEMBLY

FIELD OF THE INVENTION

The present invention generally relates to a cleaning assembly and more particularly, to a hand-held cleaning assembly which may be selectively used to easily clean a surface, such as but not limited to a wall of a shower.

BACKGROUND OF THE INVENTION

A surface, such as a wall of a shower or other portion of a house or structure, is typically cleaned by the use of a cloth or a paper towel. Particularly, water and/or a cleaning solution are initially applied to the cloth or paper towel and the water or cleaning solution containing cloth or paper towel is then forcibly placed (e.g., "rubbed") against the surface which is to be cleaned.

While the foregoing conventional cleaning approach does allow a surface to be cleaned, it suffers from some drawbacks. By way of example and without limitation, the foregoing conventional approach requires the individual to stoop, bend, stretch, or otherwise contort their body in order to fully clean the entire surface or assembly, thereby increasing the likelihood of injury and increasing the amount of effort or work required to effectuate the cleaning. Further, the foregoing conventional cleaning approach requires frequent interruption for the application of additional cleaning solution or water to the cloth or towel, thereby undesirably lengthening the overall cleaning process and requiring a relatively large amount of towels or cloths to effectively clean a relatively large area since these cloths are frequently damaged or destroyed and since the towels must be frequently cleaned.

In order to overcome these previously delineated drawbacks, several approaches have been advanced requiring the use of a "stick" or member and a cleaning head which is disposed upon the stick or member and which is used to selectively clean a surface, object, and/or assembly. While these approaches do sometimes reduce the amount of bending or stooping required to clean some of the surfaces or objects, they actually increase the complexity and the amount of effort required to clean other surface and/or objects due to the use of a member of a fixed length. That is, if the fixed length of the member is relatively short, the cleaning assembly may not be readily used in locations which are remote (e.g., above) the user and if the fixed length of the member is relatively long, the cleaning assembly may not be readily used in relatively "close quarters" or relatively "tight" locations. Further the cleaning head is not adapted to readily follow the contours of the surface or object which is to be cleaned since it is stationarilly mounted upon the fixed length member, thereby causing many portions of the surface or object to remain "uncleaned". Further, the head must be frequently cleaned, thereby undesirably interrupting the overall cleaning operation and the head is usually fixed to the member or removed only with a relatively large degree of effort, thereby undesirably and further complicating the overall cleaning process.

The present invention overcomes these and other drawbacks which are associated with current cleaning assemblies and techniques, in a new and novel fashion.

SUMMARY OF THE INVENTION

It is a first non-limiting advantage of the present invention to provide a cleaning assembly which overcomes at least some of the previously delineated drawbacks of prior cleaning assemblies.

It is a second non-limiting advantage of the present invention to provide a cleaning assembly which overcomes at least some of the previously delineated drawbacks of prior cleaning assemblies and which includes a telescoping handle and a surface engagement portion which is pivotally coupled to the telescoping handle.

It is a third non-limiting advantage of the present invention to provide a cleaning assembly which overcomes at least some of the previously delineated drawbacks of prior cleaning assemblies and which includes a telescoping handle; a bar which is pivotally coupled to the telescoping handle and having a surface including at least one projection member; and a sponge which is selectively placed upon the at least one projection member and which is attached to the surface by a plurality of serrations.

It is a fourth non-limiting advantage of the present invention to provide a cleaning assembly which overcomes at least some of the previously delineated drawbacks of prior cleaning assemblies and which includes a surface engagement portion; a hollow handle portion which is coupled to the surface engagement portion and which contains a quantity of detergent material; and a member which is movably coupled to the hollow handle and which allows at least a portion of the quantity of contained detergent material to be communicated from the hollow handle to the surface engagement portion.

These and other features and advantages of the present invention will become apparent from a reading of the following detailed description of the preferred embodiment of the invention in combination with the attached drawings.

DETAILED DESCRIPTION OF THE PREFERRED EMBODIMENT OF THE INVENTION

Figure 1:
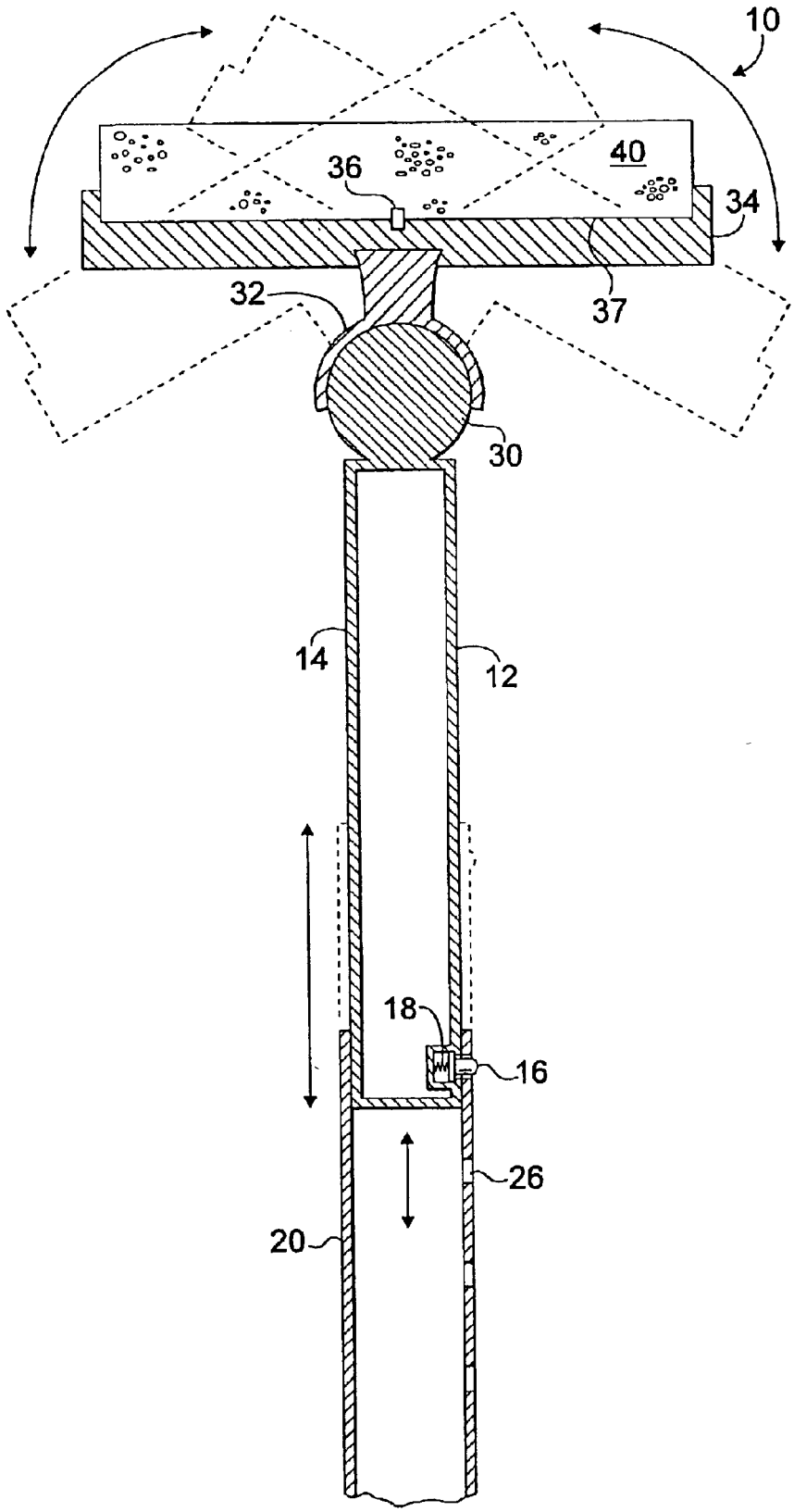
FIG. 1 is a side sectional view of a cleaning assembly which is made in accordance with the teachings of the preferred embodiment of the invention.

Referring now to FIG. 1, there is shown a cleaning assembly 10 which is made in accordance with the teachings of the preferred embodiment of the invention. Particularly, cleaning assembly 10 includes a telescoping and generally hollow handle portion 12 having, in one non-limiting embodiment, an upper portion 14 having an outwardly protruding and selectively movable detent member 16 which is biased in an outward position by a spring 18. Moreover, as shown, the handle portion 12 also includes a generally cylindrical shaped second or bottom portion 20 which movably receives the upper portion 14 and which includes several substantially identical apertures 26 along its length. Particularly, as the top portion 14 is moved along and within the bottom portion 20, one of the apertures 26 is aligned with the detent member 16. Once the detent member 16 and desired aperture 26 are substantially aligned, the spring 18 is allowed to push the aligned detent 16 through the aligned aperture 26, thereby ensuring that the portions 20 and 14 remain in a relatively stable relationship (e.g., ensuring that the bottom portion 20 is fixed with respect to the upper portion 14) and thereby allowing the handle 12 to be selectively lengthened and shortened as desired.

Further, as shown, the cleaning assembly 10 includes a conventional ball and socket type joint 30, 32, wherein ball portion 30 is fixedly coupled to an end of the top portion 14. The socket portion 32 of cleaning assembly 10 movably and frictionally receives the ball 30 and which terminates into a tray portion 34 having at least one protruding or projection member 36 which selectively receives a sponge 40 and which fixes the received sponge 40 within the tray 34.

In operation, the length of the handle portion 12 is adjusted to a desired length by selective and manual depression of detent member 16 and subsequent alignment of detent member 16 with a particular aperture 26. A sponge 40 is positioned within the tray 34 and upon the projecting portion 36. Water and/or a cleaning solution is applied to the sponge 40 and the sponge 40 is applied to an area or object which is to be cleaned. Particularly, the sponge 40 may pivot or move about the area or object to be cleaned by use of the ball and socket portions 30, 32. It should be appreciated that, in the above described manner and the manners which are described below in this detailed description, cleaning assembly 10 may be conveniently retracted to a substantially compact size which allows space-saving storage in substantially any desired area while obviating any disassembling or "break-down" of the cleaning assembly 10 into separate components.

Figure 2:
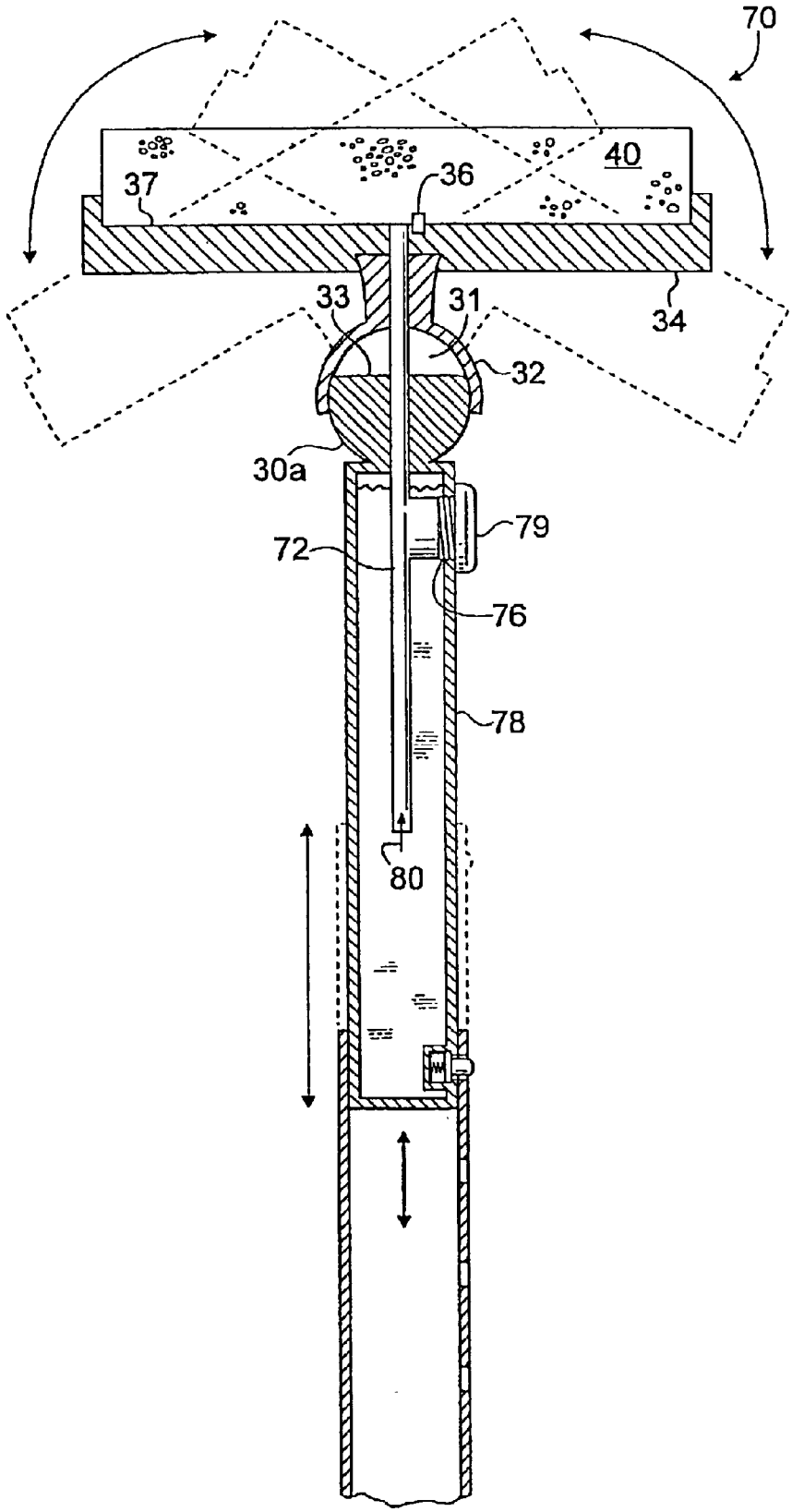
FIG. 2 is a side sectional view of cleaning assembly which is made in accordance with a first alternate embodiment of the invention.

Referring now to FIG. 2, there is shown a cleaning assembly 70 which is made in accordance with the teachings of an alternate embodiment of the invention. Particularly, the cleaning assembly 70 differs from the cleaning assembly 10 by the use of a flexible channel 72 which is disposed within the top portion 14, which communicates with an orifice 76 which is formed upon the surface 78 of the top portion 14, and which communicates with the inner sponge reception surface 37 of the tray 34. The orifice 76 selectively and removably receives a cap 79 which is effective to selectively and sealingly close the orifice 76. Further, in this non-limiting embodiment, the handle portion 12 is made from a compressible material, such as but not limited to plastic.

Further, in this non-limiting embodiment, the top portion 33 of ball portion 30*a* is substantially flat (i.e., the upper portion of ball 30 is removed), thereby leaving a semi-spherical gap 31 between the inner surface of socket 32 and ball 30*a*. In this embodiment of the invention and in the embodiments that follow, gap 31 provides a relief or clearance for flexible channel 72 to pass through ball 30*a* and socket 32 while allowing joint 30*a*, 32 to move in substantially any direction without "pinching" or collapsing channel 72.

In operation, water or a cleaning solution 80 is communicated to the channel 72 through the orifice 76. Once the material 80 is placed in the channel 72, the cap 79 is placed into the orifice 76, thereby being effective to ensure that the material 80 remains within the channel 72 and does not exit the orifice 76.

As before, the handle 12 is adjusted to a desired length and the sponge 40 is applied to a targeted object or space. Particularly, once the sponge 40 is placed upon the targeted object or space, the handle portion 12 is squeezed, effective to cause at least some of the contained material 80 to be communicated to the sponge 40, effective to cause the communicated material 80 to be placed upon the targeted object or location, thereby aiding in the cleaning of the object or location.

Figure 3:
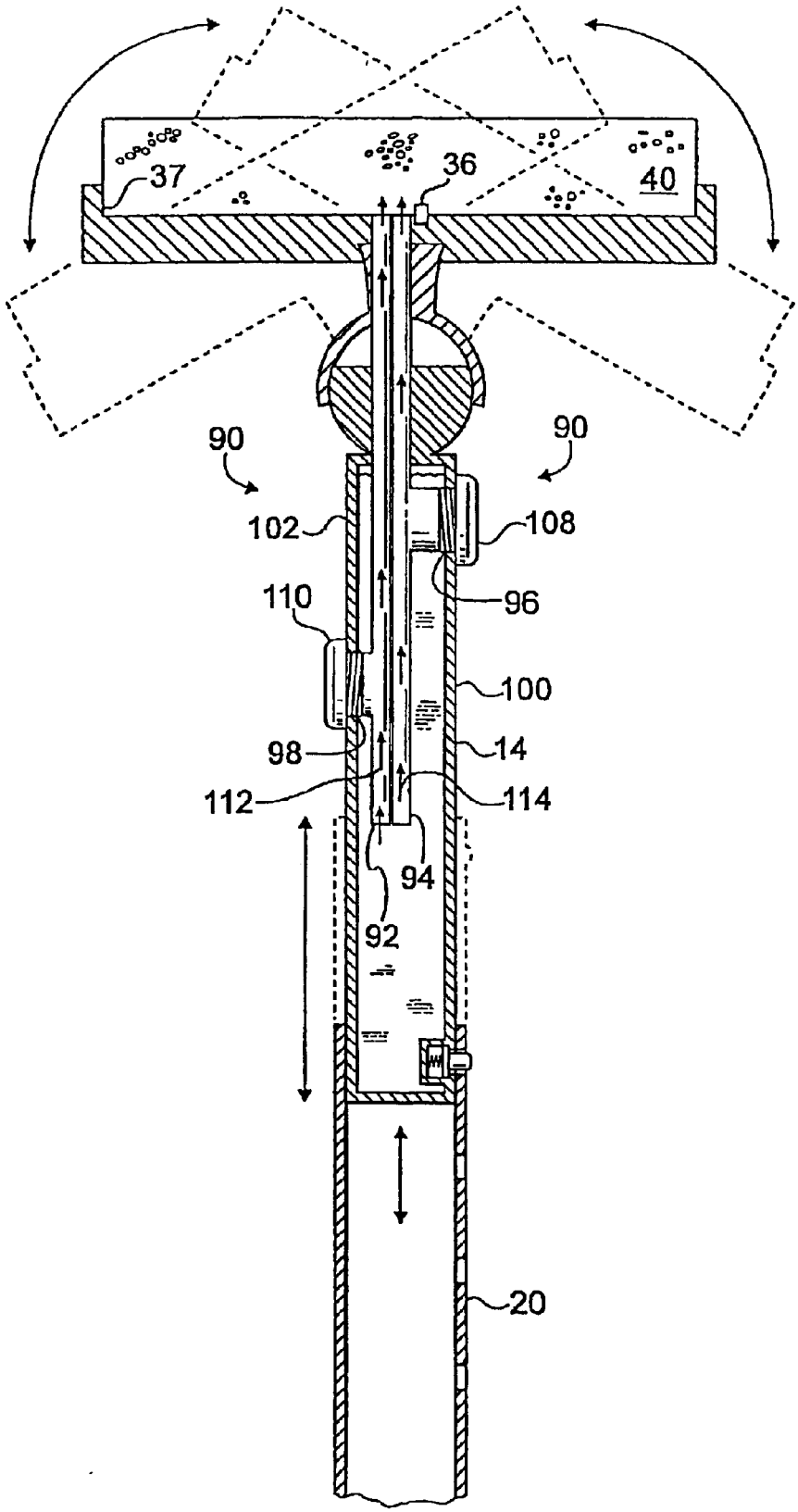
FIG. 3 is a side sectional view of a cleaning assembly which is made in accordance with the teachings of a second alternate embodiment of the invention.

Referring now to FIG. 3, there is shown a cleaning assembly 90 which is made in accordance with yet another embodiment of the invention. Particularly, cleaning assembly 90 differs from cleaning assembly 70 in that a pair of flexible channels 92, 94 are used within the handle portion 12. Each flexible channel 92, 94 respectively communicates with an orifice 98, 96 which are respectively formed on surface 102, 100 of the handle portion 12. Each orifice 96, 98 may be respectively, selectively, and sealingly closed by a cap 108, 110. It should be appreciated that, in the preferred version of this embodiment, channel 94, orifice 96, and cap 108 are substantially identical to channel 72, orifice 76, and cap 79 described above.

In operation, channels 92, 94 may selectively and respectively receive water and/or a cleaning solution 112, 114 and the received solution 112, 114 may be forced to be communicated to the sponge 40 by a depression or "squeezing" of the handle portion 12, effective to aid in the overall cleaning process. Further, as shown in FIG. 3, channel 92 is communicatively coupled to the inner cavity of generally hollow member 14, thereby permitting a relatively large amount of solution 112, 114 to be retained by cleaning assembly 90. The use of these two flexible channels 92, 94 allows greater and varying amounts of cleaning material to be placed within the assembly 90.

Figure 4:
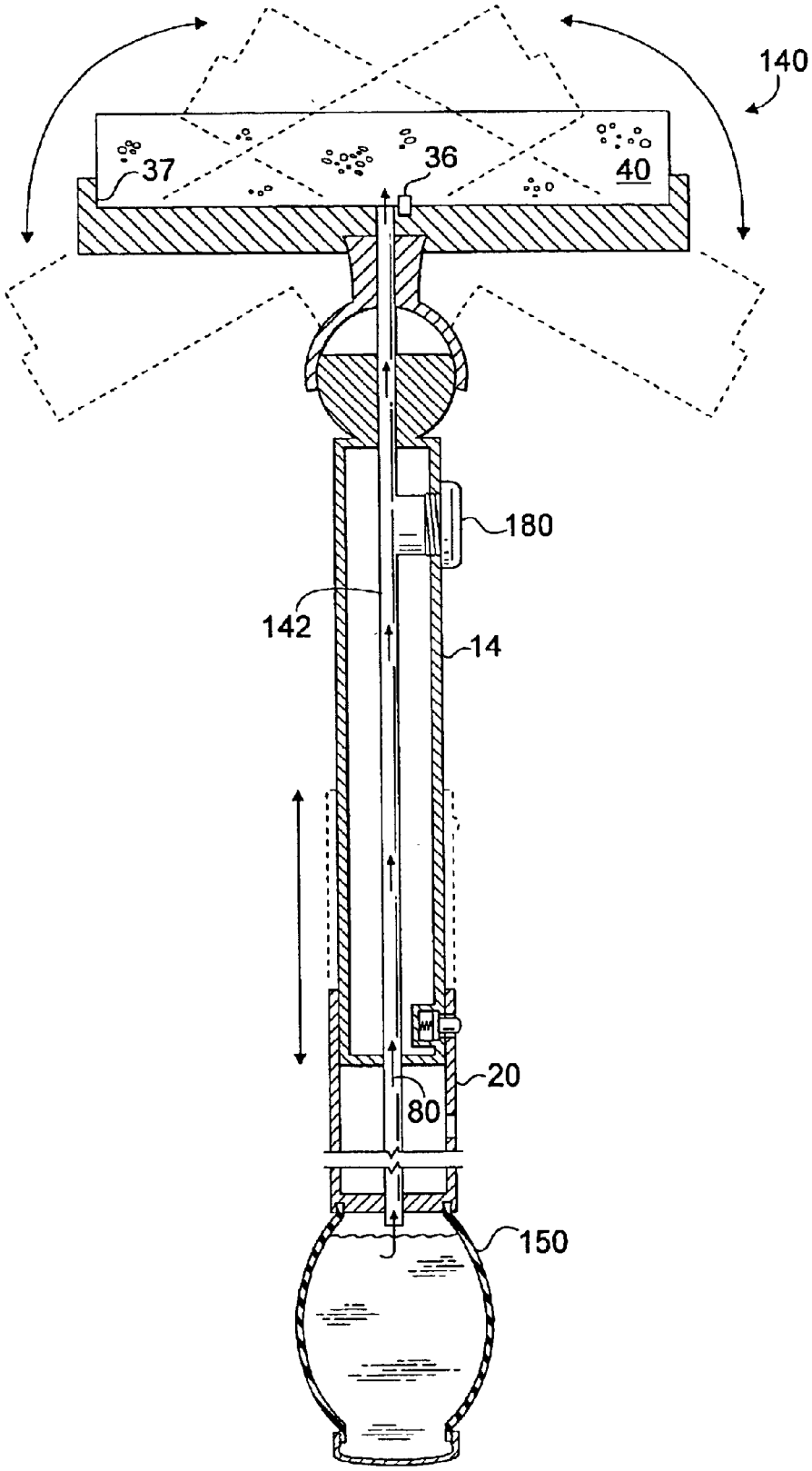
FIG. 4 is a side sectional view of a cleaning assembly which is made in accordance with the teachings of a third alternate embodiment of the invention.

Referring now to FIG. 4, there is shown a cleaning assembly 140 which is made in accordance with yet another embodiment of the invention. Particularly, the cleaning assembly 140 is substantially similar to the cleaning assembly 70 of FIG. 2 except that, in this non-limiting embodiment, the contained flexible channel 142 passes through member 14 into member 20 and terminates in a selectively "squeezable" ball 150 which also receives material 80 and, when selectively squeezed, causes at least some of the received material 80 to be communicated to the sponge 40.

It should be appreciated that nothing in this description is meant to limit the sponge 40 to any shape, geometry, size, or texture. Rather, the shape, geometry, size, and texture of sponge 40 which are shown in FIGS. 1-4 are merely for illustrative purposes only and one who is skilled in the relevant art should realize that a plurality of shapes, geometric configurations, sizes, and/or textures may be used to form the sponge 40. For example and without limitation, sponge 40 may be substantially curved, circular, oval, curved only on one side and straight on the remaining sides, and the like. In further example and without limitation, sponge 40 may include an abrasive material or a soft polishing material, such as terry-cloth, which substantially covers the entire workable surface, a portion of the workable surface, and the like. Further in example and without limitation, sponge 40 may be substantially any size which is required, desired, or applicable for substantially any desired cleaning, polishing, dusting, buffing, and the like duty for which a user of the invention deems fit.

It is to be understood that the invention is not limited to the exact construction or method which has been described above, but that various modifications may be made without departing from the spirit and the scope of the inventions as are further delineated in the following claims.

What is claimed is:

1. A cleaning assembly comprising a first generally hollow handle portion having a selectively retractable detent which protrudes from said first generally hollow handle portion, wherein said first generally hollow handle portion further includes a semi-spherical portion having a flat surface which terminates into a generally round body portion and wherein said first generally hollow handle portion also includes an orifice; a second generally hollow handle portion which selectively and slidably receives said first handle portion and which includes at least one orifice which selectively and removably receives said selectively retractable detent, thereby selectively securing said second handle portion to said first handle portion; a socket which is coupled to said generally round body portion of said semi-spherical portion and which overlays and cooperates with said flat surface to form a semi-spherical gap; a tray member which is coupled to said socket; a sponge member which is removably coupled to said tray member; and a generally hollow flexible channel which is disposed only within said first handle portion and within said semi-spherical portion and within said socket member and within said tray member and which communicates with said orifice of said first generally hollow handle portion, effective to allow said flexible channel to receive cleaning solution through said orifice of said first generally hollow handle portion and to thereafter communicate said at least a portion of said received cleaning solution to said sponge; and a cap which is removable coupled to and which selectively overlays said orifice of said first handle portion, wherein said semi-spherical gap permits the socket to move along said generally round body portion in substantially any direction without pinching said first generally hollow flexible channel.

2. The cleaning assembly of claim 1 further comprising a second generally hollow flexible channel which is linearly coextensive to said first generally hollow flexible channel and which traverses only through said first generally hollow handle portion, said semi-spherical portion, said socket, and said tray and which is communicatively coupled to a second orifice upon said first generally hollow handle portion and wherein said cleaning assembly further includes a second cap which selectively overlays said second orifice.

3. The cleaning assembly of claim 2 wherein each of said first and second flexible channels perpendicular extend into said tray member.

4. The cleaning assembly of claim 3 wherein each of said first and second flexible channels receive cleaning solution only through side surfaces of said first generally hollow handle member.

* * * * *